US011183156B2

(12) United States Patent
Austad

(10) Patent No.: US 11,183,156 B2
(45) **Date of Patent: *Nov. 23, 2021**

(54) ILLUMINATING BOWS FOR PLAYING STRINGED MUSICAL INSTRUMENTS

(71) Applicant: Chaos Manufacturing, L.L.C., Saratoga Springs, UT (US)

(72) Inventor: Zachary G. Austad, Saratoga Springs, UT (US)

(73) Assignee: Chaos Manufacturing, L.L.C., Saratoga Springs, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/709,652

(22) Filed: Dec. 10, 2019

(65) Prior Publication Data

US 2020/0349909 A1 Nov. 5, 2020

Related U.S. Application Data

(63) Continuation of application No. 15/967,316, filed on Apr. 30, 2018, now Pat. No. 10,535,326.

(60) Provisional application No. 62/492,810, filed on May 1, 2017.

(51) Int. Cl.

| | |
|---|---|
| ***G10D 3/16*** | (2020.01) |
| ***F21V 33/00*** | (2006.01) |
| *F21Y 115/10* | (2016.01) |
| *F21Y 103/10* | (2016.01) |

(52) U.S. Cl.

CPC ..... *G10D 3/16* (2013.01); *F21V 33/008* (2013.01); *F21V 33/0056* (2013.01); *F21Y 2103/10* (2016.08); *F21Y 2115/10* (2016.08)

(58) Field of Classification Search

CPC ..... G10D 3/16; F21V 33/008; F21V 33/0056; F21Y 2103/10; F21Y 2115/10

See application file for complete search history.

(56) References Cited

U.S. PATENT DOCUMENTS

| | | | | |
|---|---|---|---|---|
| 10,210,847 | B1 * | 2/2019 | Leslie | F21V 33/0056 |
| 2014/0245876 | A1 * | 9/2014 | Kunstadt | G10D 3/16 84/282 |

* cited by examiner

*Primary Examiner* — Kimberly R Lockett
(74) *Attorney, Agent, or Firm* — Stoel Rives LLP; R. Whitney Johnson

(57) ABSTRACT

An illuminating musical bow for visually enhanced performance when playing stringed instruments is disclosed. The illuminating musical bow may include a light source disposed within a hollow or cavity that is disposed within a transparent or translucent stick of the bow.

19 Claims, 8 Drawing Sheets

ILLUMINATING BOWS FOR PLAYING STRINGED MUSICAL INSTRUMENTS

RELATED APPLICATIONS

This application is a continuation of U.S. patent application Ser. No. 15/967,316, filed Apr. 30, 2019, and titled ILLUMINATING BOWS FOR PLAYING STRINGED MUSICAL INSTRUMENTS, which claims priority to U.S. Provisional Application No. 62/492,810, filed May 1, 2017 and titled ILLUMINATING BOWS FOR PLAYING STRINGED INSTRUMENTS, each of which is hereby incorporated by reference in its entirety.

TECHNICAL FIELD

The present disclosure is directed to musical instruments, and more particularly to bows for playing stringed musical instruments.

BACKGROUND

A bow can be moved across one or more instrument strings of a stringed musical instrument causing a vibration and producing sound. A set of bowstrings stretched along a frame of the bow is run along one or more instrument strings of the musical instrument to vibrate the one or more instrument strings and thereby produce sound (e.g., music). Changing which instrument strings are contacted by the set of bowstrings can change the pitch of the sound produced. Bows traditionally comprise a stick, a pad or grip handle, hair or fiber, a tip, a frog, and an adjusting tension screw. While traditional bows have been around for many years, there have been shortcomings in providing visual entertainment and visual artistic expression.

SUMMARY

The present disclosure is directed to an illuminating musical bow for visually enhanced performance when playing stringed instruments. The illuminating musical bow may include a light strip or other light source disposed within a channel or other hollow disposed internally within a transparent and/or translucent stick of the bow. An on/off mechanism found at the base of an electronics housing can activate the light source. Some non-limiting aspects and advantages provided by illumination of the bow may include increasing visual expression and enhancing entertainment.

Additional aspects and advantages will be apparent from the following detailed description of preferred embodiments, which proceeds with reference to the accompanying drawings.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

It will be readily understood that the components of the embodiments as generally described and illustrated in the figures herein could be arranged and designed in a wide variety of different configurations. Thus, the following more detailed description of various embodiments, as represented in the figures, is not intended to limit the scope of the present disclosure, but is merely representative of various embodiments. While various aspects of the embodiments are presented in drawings, the drawings are not necessarily drawn to scale unless specifically indicated.

The phrase "coupled to" is broad enough to refer to any suitable coupling or other form of interaction between two or more entities, including mechanical and electrical interaction. Thus, two components may be coupled to each other even though they are not in direct contact with each other. The phrase "attached to" refers to interaction between two or more entities which are in direct contact with each other and/or are separated from each other only by a fastener of any suitable variety (e.g., mounting hardware or an adhesive).

The terms "proximal" and "distal" are opposite directional terms. The distal end of a device or component is the end of the component that is furthest from the musician's hand during ordinary use. The proximal end refers to the opposite end, or the end nearest the musician's hand during ordinary use.

Figure 1:
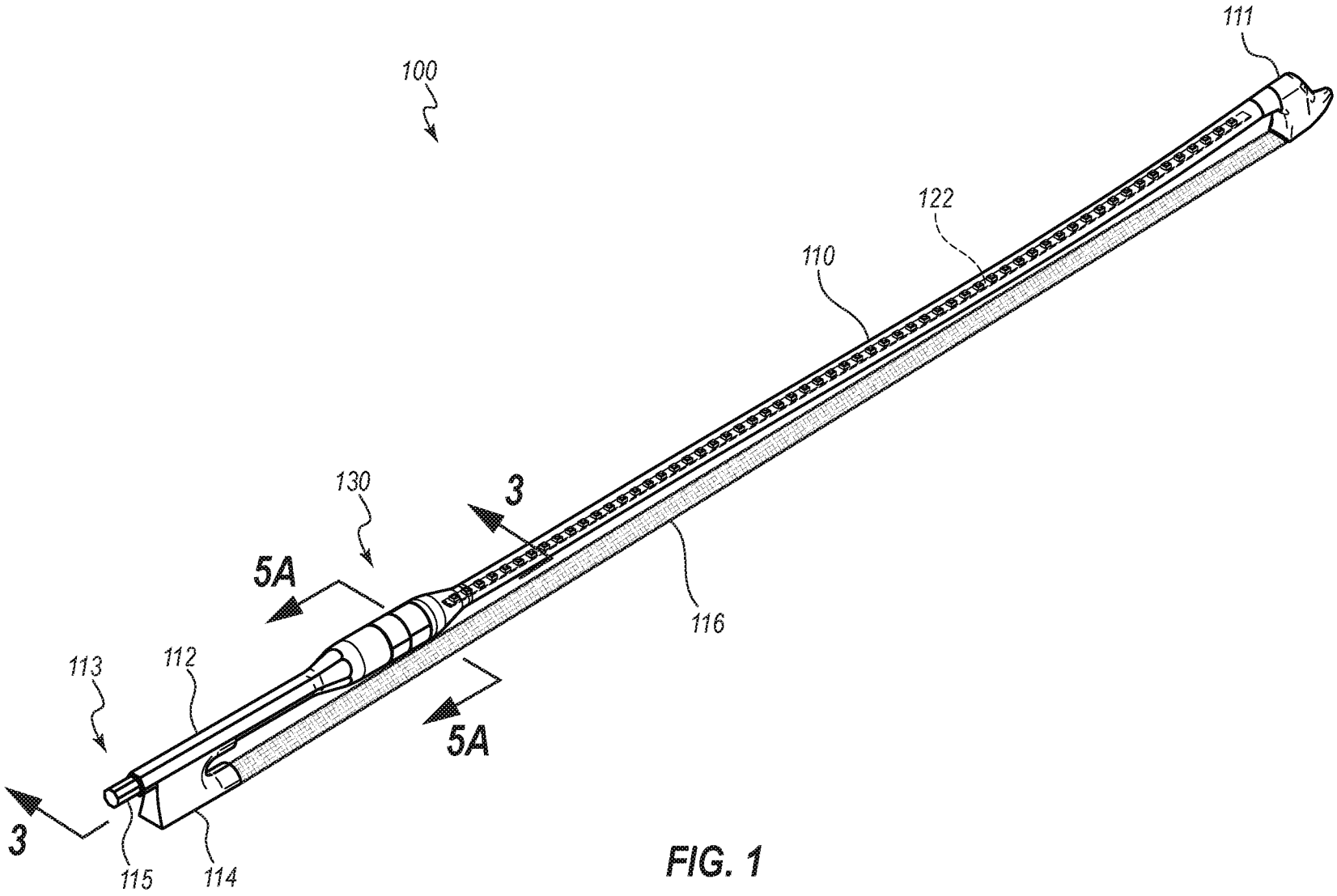
FIG. 1 is a perspective view of an illuminating musical bow, according to one embodiment of the present disclosure.
Figure 2:
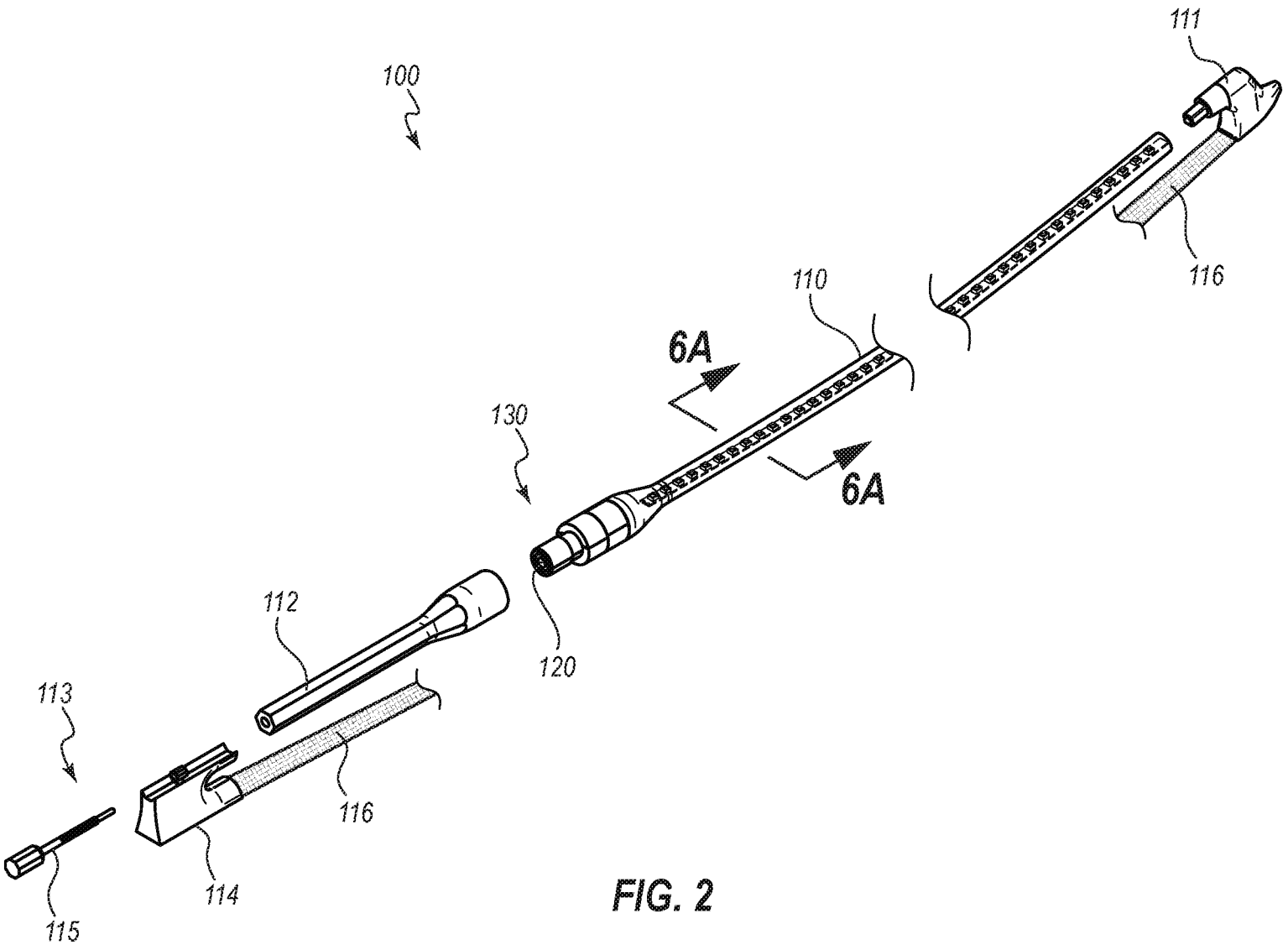
FIG. 2 is an exploded perspective view of the illuminating musical bow of FIG. 1.

FIG. 1 is a perspective view of an illuminating musical bow 100, according to one embodiment. FIG. 2 is an exploded perspective view of the illuminating musical bow 100. Referring generally and collectively to FIGS. 1 and 2, the illuminating musical bow 100 includes a stick 110, a tip 111, a base 112, a set of bowstrings 116, and a bow frog 114. The base 112 further comprises a tensioning mechanism 113 and an adjustment screw 115. The illuminating musical bow 100 may comprise a light source 122 and a power source 120 (see FIG. 3). The power source 120 may be contained in a power source housing 130. As depicted in FIG. 1, the light source 122 may be disposed within the illuminating musical bow 100. The illuminating musical bow 100 of FIG. 1 may be for use with a cello. As can be appreciated, other embodiments of the illuminating musical bow 100 may be configured for use with other stringed instruments, such as a violin, viola, fiddle, bass, and the like.

The illuminating musical bow 100 comprises a proximal portion and a proximal end. A musician may grip the illuminating musical bow 100 at the proximal portion. The illuminating musical bow 100 also comprises a bottom side adjacent the bowstrings 116 and a top side opposite the bowstrings 116.

The stick 110 may be a longitudinal shaft to which one or more components are coupled. The tip 111 may be fixedly coupled to the stick 110 at the distal end, and the base 112 may be coupled to the stick 110 at the proximal end. A power source housing 130 may also be coupled to the stick 110 and/or base 112.

The stick 110 may be formed of any appropriate material, including but not limited to wood, plastic, Lexan, carbon fiber, fiberglass, 3D printed material or other suitable material. The stick 110 may provide a structural framework to which the other components of the illuminating musical bow 100 attach. In some embodiments, components of the illuminating musical bow 100 may be an integrally formed portion of the stick 110.

The stick 110 may comprise cross-sectional shapes and dimensions configured to provide suitable rigidity, flexibility, weight balance, coupling of components, etc. The cross-sectional dimensions of the stick 110, for example, thickness, width, height, etc., may vary along the length of the stick 110. The stick 110 may be cross-sectionally symmetrical or non-symmetrical. The cross-section of the stick 110 may be round, oblong, or polygonal in shape. The stick 110 may comprise a camber or bend over at least a portion its length, and the camber or bend may be configured such that tension in the bowstrings 116 causes the stick 110 to straighten and provide for a desirable distance between the stick 110 and the bowstrings 116. The stick 110 may also comprise a solid or hollow cross-section along any portion of its length.

The set of bowstrings 116 may be made of horsehair, nylon, or other related materials. Bowstrings 116 may be comprised of many fine fibers mechanically attached to one another at least one end of the bowstrings by an adhesive, such as glue, or another mechanical connector, for example. The bowstrings 116 may include fibers, which when taut and moved across a string or strings of a musical instrument produce vibration. The orthogonal translational contact of the bowstrings 116 across the strings of a musical instrument (e.g., a cello) creates sound. The bowstrings 116 may span the length of the stick 110 by being secured to the distal and proximal ends of the illuminating musical bow 100. The bowstrings 116 may be tightened for playing the musical instrument and may be subsequently loosened after playing, for example, for storage. The stick 110 is configured to facilitate tension, i.e. a tight condition, of the bowstrings 116. The bowstrings 116 of the illuminating musical bow 100 may become unsuitable for use and may be replaced.

The illuminating musical bow 100 also comprises a tip 111 at the distal end. The tip 111 may facilitate coupling of one end of the bowstrings 116 to the distal end of the stick 110. The tip 111 may comprise features and components and/or otherwise be configured for detachment and re-attachment of one end of the bowstrings 116. The tip 111 may also be configured to comprise the light source 122 (see FIG. 3). The tip 111 may be formed of a rigid material, including but not limited to wood, plastic, Lexan, fiberglass, or other suitable materials. In some embodiments, the tip 111 may be configured to comprise an additional light source.

The base 112 may be fixedly or detachably coupled to the proximal end of the stick 110. The base 112 may comprise a gripping portion so as to facilitate gripping of the illuminating musical bow 100 at the proximal portion by a hand of the musician. The base 112 may comprise shapes, features, and additional components and materials (not shown) to facilitate the grip-ability of the illuminating musical bow 100. The base 112 may be manufactured of any suitable rigid material, such as aluminum, plastic, carbon fiber, etc.

The frog 114 of the illuminating musical bow 100 may facilitate coupling the bowstrings 116 at the proximal portion of the illuminating musical bow 100. The frog 114 may comprise features and components, and/or otherwise be configured for detachment and re-attachment of one end of the bowstrings 116. The frog 114 may also be slidably coupled to the base 112. The bow frog 114 may be formed of ebony, synthetic plastics, woods, or other suitable materials.

Figure 3:
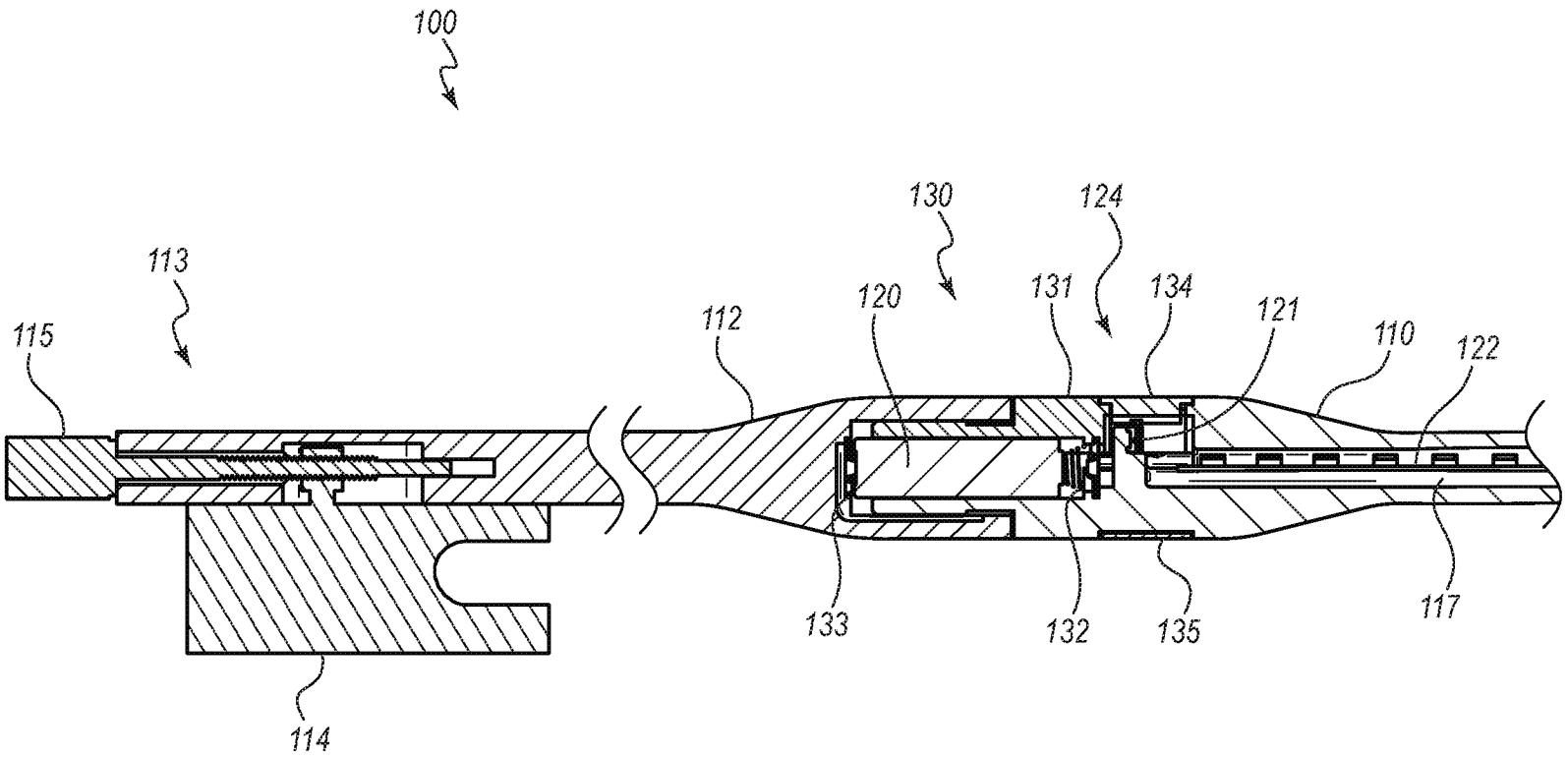
FIG. 3 is a cross-sectional side view taken along line 3-3 of a proximal portion of the illuminating musical bow of FIG. 1.

The base 112 may also comprise a tensioning mechanism 113 configured to adjust the longitudinal position of the frog 114 relative to the base 112, resulting in adjustment of the tension in the bowstrings 116. As shown in FIGS. 2 and 3, the tensioning mechanism 113 may comprise a screw 115 configured for manual rotation. The frog 114 may be coupled to the screw 115 so that rotation of the screw 115 results in longitudinal displacement of the frog 114 along a portion of the length of the base 112, which, in turn, results in adjustment of the tension in the bowstrings 116. The screw 115 may be rotated by the hand of the user so as to create the desired tension in the bowstrings 116 for playing the stringed instrument and subsequently oppositely rotated to relieve tension in the bowstrings 116. The screw 115 may be made of metal, plastic, or other suitable materials.

Figure 4:
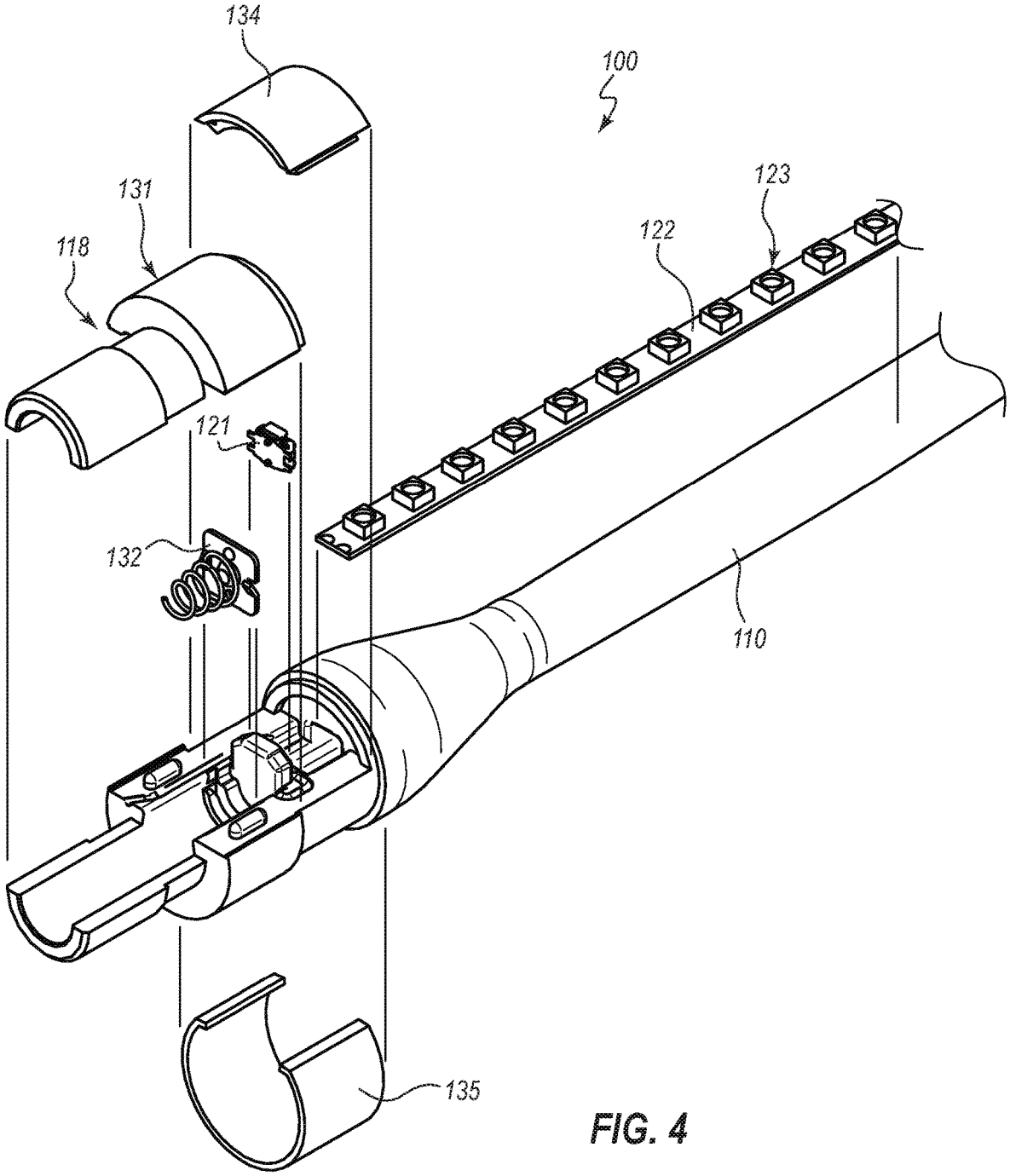
FIG. 4 is an exploded perspective view of a proximal portion of the illuminating musical bow of FIG. 1.

Referring now to FIGS. 3 and 4, the illuminating musical bow 100 may comprise electrical components configured to provide electrical power to the light source 122. The electrical components may include a power source 120, a switch 121 and other components/features configured for electrical coupling of the power source 120, switch 121 and light source 122 to each other.

The power source 120 may comprise one or more batteries, which may be coupled together in series or parallel. The power source 120 may be rechargeable and comprise wired or wireless recharging.

The switch 121 may be configured for enabling and disabling at least one electrical connection to the power source 120. The switch 121 may be slidably or depressibly activated. The switch 121 may be normally "off" switch or normally "on" switch. The switch 121 may comprise detents in the "on" and/or "off" positions. The switch 121 may also provide audible or tactile feedback when transitioned between the "on" and "off" positions. The switch 121 may be configured for operation by a hand and/or fingers of the musician and more specifically, the hand and/or fingers gripping the illuminating musical bow 100 at the gripping portion. As such, the switch 121 may comprise a push button, slidable member, toggle lever, etc. Further operational description of the switch 121 follows below.

The electrical coupling between the power source 120, the switch 121 and the light source 122 may comprise any suitable method for conducting electricity, including wires, metal straps, etc. Conducting electricity may also include electrical conduction properties of materials that may be used in the construction of the illuminating musical bow 100, for example aluminum, conductive plastic, etc.

The power supply housing 130 may be configured to contain the power source 120, the switch 121, etc. As shown in FIG. 3, the power source housing 130 may comprise an enlarged proximal portion of the stick 110 and an enlarged distal portion of the base 112. The stick 110 and the base 112 may be slidably coupled together in a circumferential overlapping relation at or adjacent the power source housing 130 and the coupling may be configured so that tension in the bowstrings 116 provides coupling retention. Elimination of tension in the bowstrings 116 may provide for decoupling and subsequent access to the power source 120. The enlargement of the cross-sections of the stick 110 and the base 112 may be symmetrical or non-symmetrical to the stick 110 and the base 112. Alternatively, the power source housing 130 may be formed on an outside surface of the stick 110 and/or base 112. In some embodiments, the power supply housing 130 may comprise lateral access to the power source 120 to facilitate battery replacement, for example.

The power source housing 130 may comprise first and second power source contacts 132, 133, and additional components to facilitate manufacturing and/or operation. The first and second power source contacts 132, 133 may be coupled to the stick 110 and the base 112, respectively. As shown FIG. 3, the proximal portion of the stick 110 may form a lower portion of the power source housing 130, and an upper power source housing member 131 may form an upper portion. The coupling of the upper power source housing member 131 to the proximal portion of the stick 110 may facilitate assembly and/or coupling of the switch 121 and the first power source contact 132 to the stick 110.

As shown in FIGS. 3 and 4, the power source housing 130 may comprise an upper switch housing 134 coupled to a lower switch housing 135 which, when coupled, combine to form a switch activator 124. The lower switch housing 135 may comprise a partially cylindrical metal band configured to rotatably slide on an external cylindrical portion of the power source housing 130. In some embodiments, the switch activator 124 may be formed as a single unit.

As shown in FIG. 4, the light source 122 may comprise a series of individual light sources which may be arranged in a linear array. The light source 122 may comprise a plurality of light emitting diodes 123 (LEDs). The individual LEDs 123 may be disposed along a portion of the length of the stick 110 and may have even or un-even spacing. The spacing between the LEDs 123 may be 5 to 35 mm, 5 to 17 mm, 5 to 8 mm or less than 6 mm. The total number of LEDs 123 along the length of the stick 110 may be 22 to 420, 22 to 210, or 100 to 280. The light dispersion angle may be between 100 and 250 degrees, 100 and 130 degrees, or 230 and 250 degrees. The emitted light intensity of the illuminating musical bow 100 may be between 400 and 1400 lumens, 400 and 900 lumens, or 700 and 1000 lumens. The light source 122 may be rated for operation at 12 or 24 volts. The power consumption of the light source 122 may be between 4 and 18 watts, 4 and 10 watts, or 8 and 12 watts.

The light source 122 may comprise a flat flexible circuit substrate to which the plurality of LEDs 123 are physically and electrically coupled, and the LEDs 123 may be coupled to a single front side of the substrate, i.e. an LED light strip. The light source 122 may comprise one or more LED light strips. In some embodiments, the light source 122 may comprise a pair of LED light strips aligned in a back-to-back orientation, thus doubling the illumination and doubling the dispersion angle of the light source 122. Two or more LED light strips may be coupled together with adhesive. The LED light strips may be electrically coupled in series or parallel. The light source 122 may also comprise a one or more LED light strips folded lengthwise, for example in half.

The light source 122 may comprise one or more colors, or the light source 122 may comprise only white light. In some embodiments, multiple colors may be arranged in a repeating sequence along the length of the stick 110, for example red, green blue, etc. In other embodiments, the multiple colors may be arranged in groups or any other suitable arrangement.

Figure 5B:
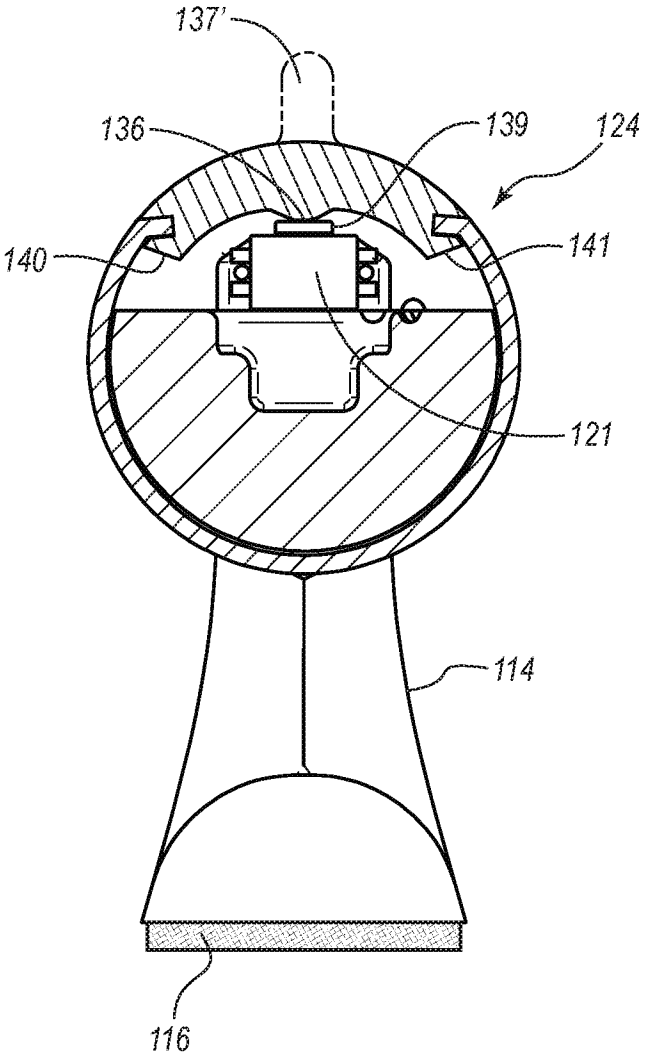
FIG. 5B is a cross-sectional view taken along line 5A-5A of the power source housing of the illuminating musical bow of FIG. 1 showing the switch in an "on" position.
Figure 5A:
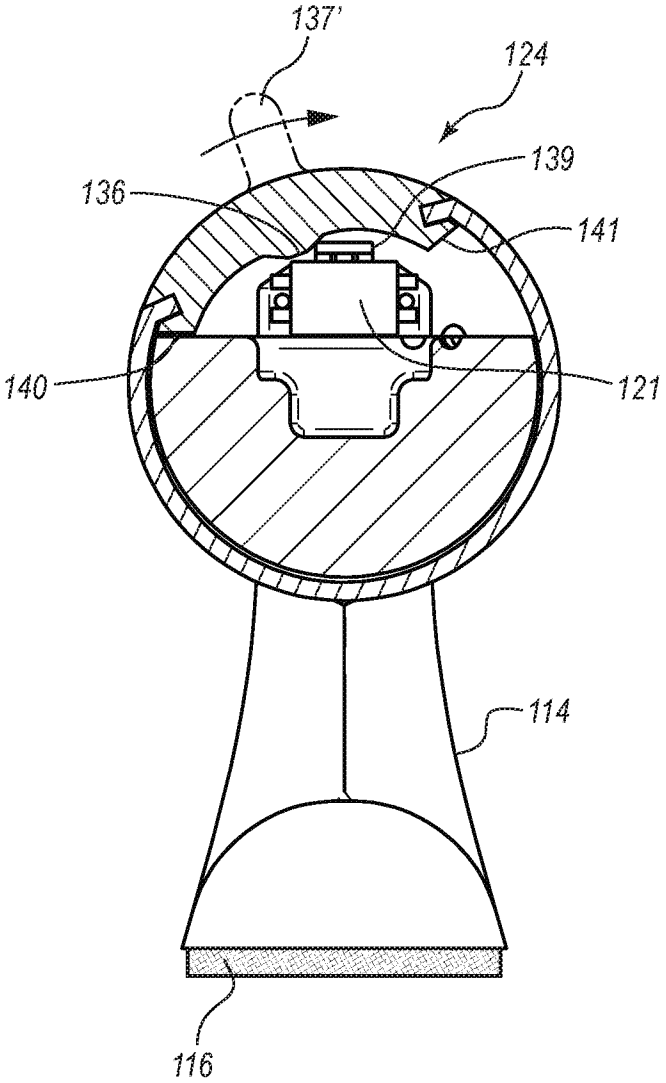
FIG. 5A is a cross-sectional view taken along line 5A-5A of the power source housing of the illuminating musical bow of FIG. 1 showing the switch in an "off" position.

Referring FIGS. 5A and 5B, the activation of switch 121 may comprise rotation of the switch activator 124. The switch 121 may comprise a momentary depressible member 139 configured to engage with a portion of the upper switch housing 134. The upper switch housing 134 may comprise at least one inner protrusion 136 configured to displace the depressible member 139 upon rotation of the switch activator 124 and thus activate the switch 121. The switch activator 124 may comprise first and second rotational stops 140, 141, which may limit rotation of the switch activator 124 in opposite directions. The switch activator 124 may comprise an outer protrusion 137' so as to facilitate one handed rotation of the switch activator 124. The outer protrusion 137' may also provide for visual observation of the "on/off" position of the switch 121.

The switch activator 124 may be rotated about the longitudinal axis of the stick 110. As shown in FIGS. 5A and 5B, the momentary depressible member 139 may not be depressed when the switch activator 124 is rotated fully counter-clockwise or clockwise and may be depressed when the switch activator 124 is located at a center position between the stops 140, 141. A person of ordinary skill in the art with the benefit of this disclosure will recognize that additional activation scenarios are possible. For example, the upper switch housing 134 may comprise more than one inner protrusion 136, resulting in multiple angular positons wherein the momentary depressible member 139 is displaced, i.e. the switch 121 is "on," and in multiple angular positons wherein the momentary depressible member 139 is not displaced, i.e. the switch 121 is "off." In some embodiments, the depressible member 139 may be displaced when the switch activator 124 is disposed at one or both stops 140, 141.

The stick 110 may comprise a light channel 117 along a portion of the length thereof configured for disposition of the light source 122 therein. The internal surfaces of the light channel 117 may comprise securement features for the light source 122, such as ridges, grooves, etc. The coupling of the light source 122 to the stick 110 may comprise an adhesive, for example an ultra-violet light activated adhesive, so as to prevent movement of the light source 122 relative to the stick 110, which movement may cause audible noise.

Figure 6B:
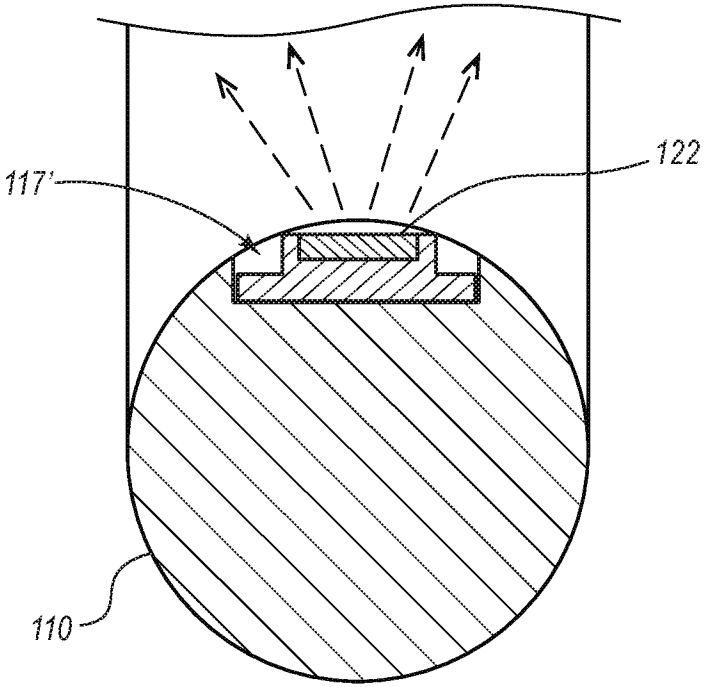
FIG. 6B is a cross-sectional view taken along line 6A-6A of the stick of the illuminating musical bow of FIG. 2 showing the light source disposed at an alternative location on an external surface of the stick.
Figure 6A:
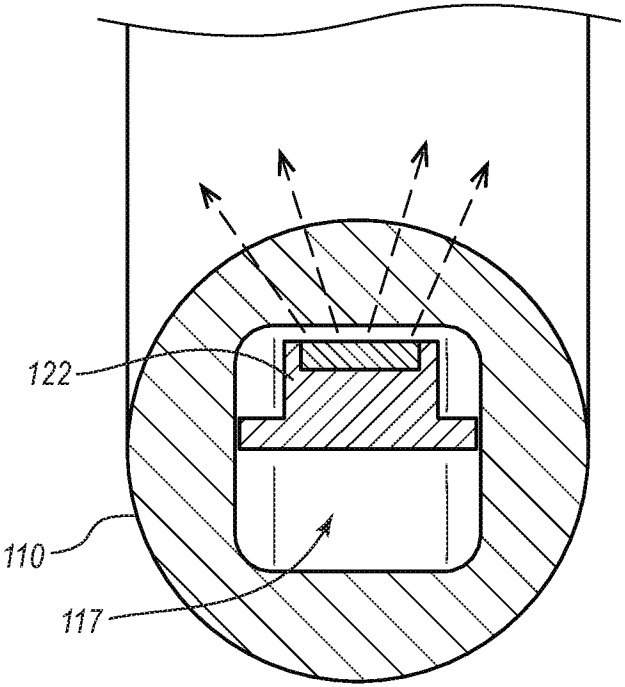
FIG. 6A is a cross-sectional view taken along line 6A-6A of the stick of the illuminating musical bow of FIG. 2 showing the light source disposed within a light channel centrally within the stick.

FIG. 6A illustrates a cross sectional view of the stick 110 taken along line 6A-6A of FIG. 2 depicting the light source 122 in the form of a single LED light strip disposed within the light channel 117, such that the LEDs 123 are directed toward the top side of the illuminating musical bow 100. In the illustrated embodiment of FIG. 6A, the light channel 117 may be hollow and disposed entirely within the stick 110. In some embodiments, the LED direction may be a different angle relative to the top side of the illuminating musical bow 100, such as between plus/minus 120 degrees relative to the top side of the illuminating musical bow 100. FIG. 6A also depicts the light channel 117 in a central location within the circumference of the stick 110. However, in some embodiments, the light channel 117 may be offset so that the LEDs 123 are positioned toward an external surface of the stick 110 so as to reduce the thickness of stick material through which the illumination must travel.

In some embodiments, the light source 122 may be disposed on an outside surface of the stick 110 in a light channel 117' as shown in FIG. 6B, for example within an external open channel. In other embodiments, the light source 122 may be attached directly to an outer surface of the stick 110.

In some embodiments, the light source 122 may comprise multiple LED light strips arranged to direct light at multiple angles. In some embodiments, the light channel 117 may rotate or twist along the length of the stick 110 so as to direct the light at different angles along the length of the stick 110. Other arrangements of LEDs 123 along the length of the stick 110 or at other locations on the illuminating musical bow 100 may be contemplated by one of ordinary skill having the benefit of this disclosure, and are within the scope of this disclosure.

The stick 110 may comprise features, shapes and colors so as to enhance the aesthetic appearance of the illuminating musical bow 100 and/or the light emitting therefrom. As such, the stick 110 may comprise portions along its length which are visually transparent or translucent. The stick 110 may also comprise portions tinted in various colors. The tinting may comprise a single color or multiple colors along the length of the stick 110. The stick 110 may have a rough, gloss, or matte finish. In some embodiments, the stick 110 may comprise reflective surfaces.

Figure 7B:
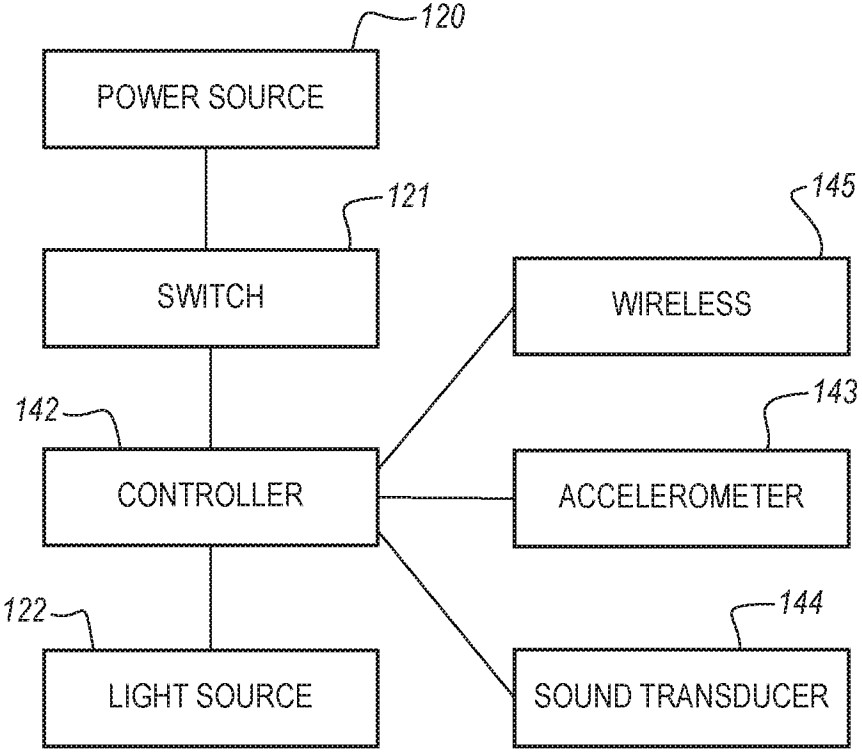
FIG. 7B illustrates electrical components of an alternative embodiment of the illuminating musical bow of FIG. 1.
Figure 7A:
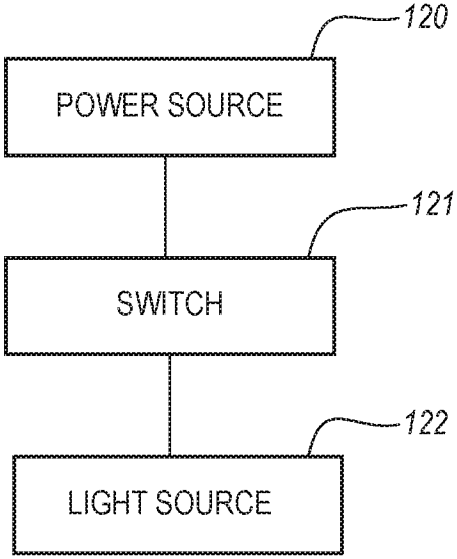
FIG. 7A illustrates electrical components of the illuminating musical bow of FIG. 1.

FIGS. 7A and 7B illustrate electrical components of the illuminating musical bow 100. FIG. 7A depicts an instance wherein the light source 122 is coupled directly to the power source 120 via the switch 121. In this instance the light source 122 is "on" when the switch 121 is "on," and the light source 122 is "off" when the switch 121 is "off."

In some embodiments, the illuminating musical bow 100 may further include a controller 142. The controller 142 may enable the illuminating musical bow 100 to comprise multiple illumination modes. For example, in addition to simple "on/off" operation, illumination modes may comprise flashing at various frequencies, dimming, etc.

In some embodiments, additional sensors may be coupled to the controller 142, which may include, but are not limited to, an accelerometer 143, a sound transducer (microphone) 144, and a wireless component 145, for example Bluetooth®. The accelerometer 143 may facilitate illumination modes related to bow movement, string vibration, etc. In some embodiments, bow movement may also be used to turn on and off the switch to illuminate the light source 122. The sound transducer 144 may facilitate illumination modes related to musical content, pitch, sound volume, bow movement, string vibration, etc. In some embodiments, the sound transducer may also be used to turn on and off (activate) the switch to illuminate the light source 122 at a predetermined frequency range. The wireless component 145 may facilitate remote control of illumination. In such embodiments, multiple illuminating musical bows 100 may be used singularly or in groups. In some embodiments, illumination may be controlled by any one of several persons, e.g. musician, conductor, audio/visual controller, etc., or by an external programmable controller.

In some embodiments, a wireless signal may be used to activate and deactivate the light source 122. For example, a switch may be disposed somewhere off of the illuminating musical bow 100. In some embodiments, the switch may be a foot pedal that may be activated by a user's foot and when the foot pedal is activated, the pedal may send a wireless signal to activate the light source 122.

In another embodiment, the LED light strip may be an addressable LED light strip, and the controller 142 may be an addressable LED light strip controller providing for illumination control of individual LEDs 123.

In some embodiments, the illuminating musical bow 100 may comprises an on/off mechanism capable of being operated remotely, i.e. wirelessly. In such an instance, the on/off mechanism may be operated by any one of several persons, e.g. musician, conductor, audio/visual controller, etc. or by a programmable controller.

Figure 8A:
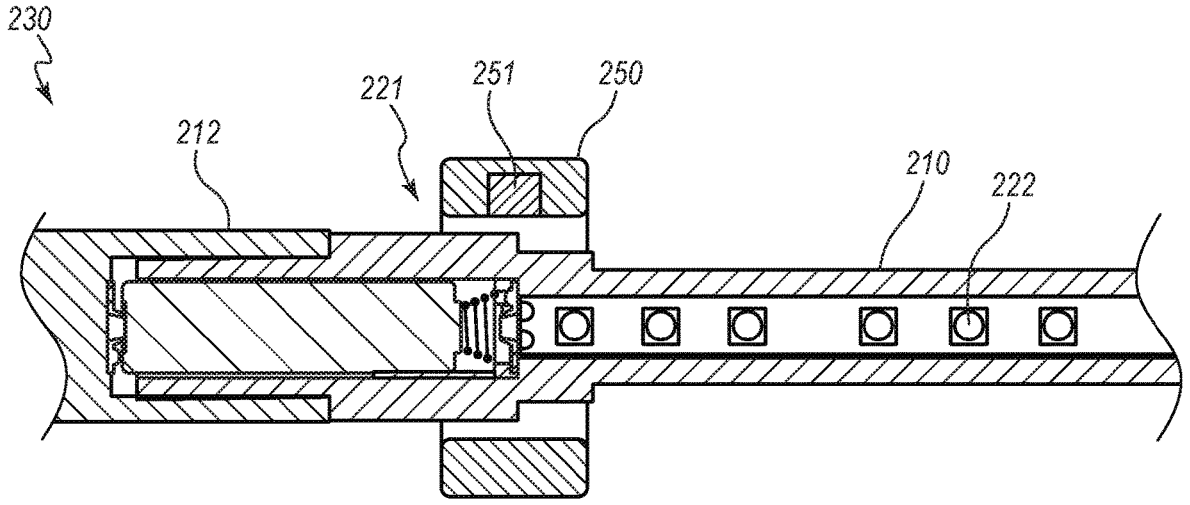
FIG. 8A is a cross-sectional side view of a proximal portion of a second embodiment of the illumination bow of FIG. 1 showing a magnetically operated switch in the "on" position.
Figure 8B:
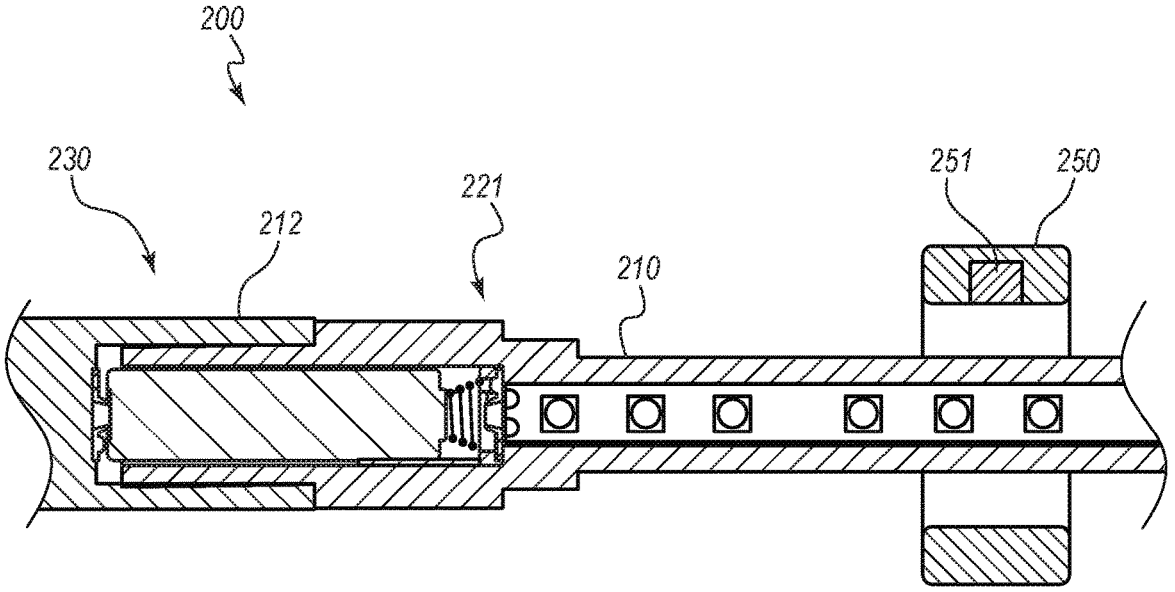
FIG. 8B is a cross-sectional side view of a proximal portion of a second embodiment of the illumination bow of FIG. 1 showing a magnetically operated switch in the "off" position.

FIGS. 8A and 8B depict an embodiment of an illumination bow 200 that resembles the illuminating musical bow 100 described above in certain respects. Accordingly, like features are designated with like reference numerals, with the leading digit incremented to "2." For example, the embodiment depicted in FIGS. 8A and 8B includes a stick 210, a light source 222, a base 212 and a power source housing 230 which may, in some respects, resemble the stick 110, light source 122, base 112 and power source housing 130 of FIG. 1. Relevant disclosure set forth above regarding similarly identified features thus may not be repeated hereafter. Moreover, specific features of the illumination bow 200 and related components shown in FIGS. 8A and 8B may not be shown or identified by a reference numeral in the drawings or specifically discussed in the written description that follows. However, such features may clearly be the same, or substantially the same, as features depicted in other embodiments and/or described with respect to such embodiments. Accordingly, the relevant description of such features applies equally to the features of the illumination bow 200 and related components depicted in FIGS. 8A and 8B. Any suitable combination of the features, and variations of the same, described with respect to the illuminating musical bow 100 and related components illustrated in FIGS. 1-7A can be employed with the illumination bow 200 and related components of FIGS. 8A and 8B, and vice versa.

The illumination bow 200 comprises a magnetically activated switch 221, for example a reed switch, disposed within the power source housing 230, and a switch activator 250 comprising a magnet 251. The switch 221 performs the same electrical function as switch 121 of illuminating musical bow 100. The switch 221 is configured to activate, i.e. turn "on," in the presence of a predetermined external magnetic field, as may be produced by a magnet disposed in close proximity to the switch 221. The switch 221 is configured to deactivate, i.e. turn "off," when the external magnetic field is removed.

The switch activator 250 comprises a collar having internal dimensions or features configured to displaceably couple with a portion of the stick 210 and/or power source housing 230. The switch activator 250 includes the magnet 251 configured to activate the switch 221 when the switch activator 250 is disposed in a first position (e.g., FIG. 8A) relative to the switch 221. The switch 221 may be deactivated when the switch activator 250 is disposed in a second position (e.g., FIG. 8B) relative to the switch 221. Displacement of the switch activator 250 may comprise rotational or sliding displacement relative to a longitudinal axis of the stick 210 and/or power source housing 230.

The switch activator 250 may comprise displacement limiting features, for example stops, and may further comprise features to prevent inadvertent displacement, such as detents, friction, etc. These may be a securement mechanism that does not enabler displacement of the switch activator 250 unless a predetermined amount of force is applied to the switch activator 250. The switch activator 250 may also comprise at least one feature on an external surface to facilitate ergonomic displacement of the switch activator 250 by a single hand of the musician and, more specifically, by the hand of the musician used to grip the illumination bow 200.

It will be obvious to those having skill in the art that many changes may be made to the details of the above-described embodiments without departing from the underlying principles of the invention. The scope of the present invention should, therefore, be determined only by the following claims.

The invention claimed is:

1. A bow to play a stringed musical instrument, the bow comprising:

a stick comprising an elongate shaft;

a grip portion disposed adjacent to a proximal end of the stick;

a bow frog coupled to the stick and positioned proximal to the grip;

a tip disposed at a distal end of the stick;

a light source extending along at least a portion of the elongate shaft;

a switch to activate the light source; and a switch activator adjacent to the grip portion, wherein the switch activator encompasses the elongate shaft and is configured to displace between an active position and an inactive position to activate and deactivate the switch.

2. The bow of claim 1, wherein the elongate shaft comprises a rigid transparent and/or translucent material and defines a hollow center light channel that extends along at least a portion of a length of the stick, and wherein the light source is disposed within the hollow center light channel.

3. The bow of claim 1, wherein the light source is secured to the elongate shaft by an adhesive.

4. The bow of claim 1, wherein the light source is a plurality of light emitting diodes.

5. The bow of claim 1, wherein the light source is configured to provide a plurality of different colors.

6. The bow of claim 1, wherein a power source is at least partially disposed within the grip portion.

7. The bow of claim 1, wherein the switch is disposed adjacent to the grip portion and distal to the bow frog.

8. The bow of claim 1, wherein the switch is activated and deactivated by a user.

9. The bow of claim 8, wherein the switch is a reed switch.

10. The bow of claim 1, wherein a magnet is disposed within the switch activator.

11. The bow of claim 1, wherein the switch activator is secured in the active position and the inactive position by a securement mechanism, and wherein the switch activator is displaceable only by an application of a predetermined amount of force to displace the switch activator to and from the different positions.

12. The bow of claim 10, wherein the switch activator is rotatable about the stick a longitudinal axis of the stick, and wherein the rotation of the switch activator moves the disposition of the magnet disposed within the switch activator.

13. The bow of claim 1, wherein the switch is activated remotely by a wireless signal.

14. The bow of claim 1, wherein the stick further comprises an accelerometer, and wherein the switch is activated by movement of the bow detected by the accelerometer.

15. The bow of claim 1, wherein the switch is configured to be activated by sounds waves within a predetermined frequency range.

16. An illuminated bow system for a stringed musical instrument, the system comprising:

a bow comprising:

a stick comprising an elongate shaft;

a grip portion disposed adjacent to a proximal end of the stick;

a bow frog coupled to the stick and positioned proximal to the grip portion;

a tip disposed at a distal end of the stick;

a light source extending along at least a portion of the elongate shaft;

a switch to activate the light source; and a switch activator adjacent to the grip portion, wherein the switch activator encompasses the elongate shaft and is configured to displace between an active position and an inactive position to activate and deactivate the switch.

17. The illuminated bow system of claim 16, wherein the switch is disposed on the bow.

18. The illuminated bow system of claim 16, wherein the switch is a foot pedal to wirelessly activate the light source, and wherein the foot pedal is to be activated by a user's foot.

19. The illuminated bow system of claim 16, wherein a plurality of bows are simultaneously activated by the switch.

* * * * *